United States Patent [19]

Kramer

[11] Patent Number: 5,031,644

[45] Date of Patent: Jul. 16, 1991

[54] TOBACCO EXPANSION PROCESS AND PRODUCT

[75] Inventor: Anatoly I. Kramer, Winston-Salem, N.C.

[73] Assignee: R. J. Reynolds Tobacco Company, Winston-Salem, N.C.

[21] Appl. No.: 459,007

[22] Filed: Dec. 29, 1989

[51] Int. Cl.[5] ..... A24B 3/18

[52] U.S. Cl. ..... 131/294; 131/295; 131/296; 131/35.2

[58] Field of Search ..... 131/296, 293, 294, 290, 131/309, 310, 352, 353

[56] References Cited

U.S. PATENT DOCUMENTS

| | | |
|---|---|---|
| 3,524,451 | 8/1970 | Fredrickson . |
| 3,524,452 | 8/1970 | Moser et al. . |
| 3,683,937 | 8/1972 | Fredrickson et al. . |
| 3,765,425 | 10/1973 | Stungis et al. . |
| 3,842,846 | 10/1974 | Laszlo . |
| 3,881,498 | 5/1975 | Wochnowski . |
| 4,153,063 | 5/1979 | Roselius et al. . |
| 4,235,250 | 11/1980 | Utsch . |
| 4,258,729 | 3/1981 | de la Burde et al. . |
| 4,289,148 | 9/1981 | Ziehn . |
| 4,336,814 | 6/1982 | Sykes et al. . |
| 4,461,310 | 7/1984 | Ziehn . |
| 4,531,529 | 7/1985 | White et al. . |
| 4,561,452 | 12/1985 | Gabrs . |

FOREIGN PATENT DOCUMENTS

| | | |
|---|---|---|
| 0280817 | 9/1988 | European Pat. Off. . |
| 0323699 | 7/1989 | European Pat. Off. . |

*Primary Examiner*—V. Millin

*Attorney, Agent, or Firm*—Grover M. Myers

[57] ABSTRACT

The invention is directed to a process for expanding tobacco wherein tobacco is impregnated with sulfur hexafluoride and thereafter heated in an expansion zone to liberate the sulfur hexafluoride and cause expansion of the tobacco. The process of the invention can provide substantial expansion of tobacco cut filler lamina without substantial generation of tobacco fines and employing substantially mild pressure of, for example, less than about 2,000 psi and with minimal effect on tobacco taste. The invention additionally provides an intermediate tobacco product comprising tobacco cut filler lamina impregnated with sulfur hexafluoride in a substantially pliable and unextracted condition.

41 Claims, 2 Drawing Sheets

TOBACCO EXPANSION PROCESS AND PRODUCT

BACKGROUND OF THE INVENTION

The invention relates to a process for tobacco expansion. More specifically, the invention relates to a process for expanding tobacco to reduce its bulk density and thereby increase its volume and filling capacity. The process is especially suitable for treating cigarette cut filler.

In the past two decades, tobacco expansion processes have become an important part of the cigarette manufacturing process. Tobacco expansion processes are used to restore tobacco bulk density and/or volume which are lost during curing and storage of tobacco leaf. In addition, expanded tobacco is an important component of many low tar and ultra low tar cigarettes.

Commercially significant tobacco expansion processes are described in U.S. Pat. No. 3,524,451 to Fredrickson and U.S. Pat. No. 3,524,452 to Moser et al. These patents describe processes wherein tobacco is contacted with a volatile organic impregnant and then heated by rapidly passing a stream of hot gas in contact with the impregnated tobacco to volatilize the impregnant and expand the tobacco. A variation of these processes is described in U.S. Pat. No. 3,683,937 to Fredrickson et al. which discloses a tobacco expansion process wherein tobacco is impregnated with a volatile organic compound in the vapor state and in the absence of any liquid or solid phase. The impregnated tobacco is expanded either by heating or rapidly reducing pressure. Heat can be applied through a stream of hot gas or through microwave treatment.

Following development and commercialization of the tobacco expansion processes described above, extensive and continuing efforts have been directed to the identification of specific expansion agents and processes for expansion of tobacco. For example, U.S. Pat. No. 4,235,250 to Utsch; U.S. Pat. No. 4,258,729 to Burde et al. and U.S. Pat. No. 4,336,814 to Sykes et al., among others, disclose the use of carbon dioxide for expanding tobacco. In these and related processes, carbon dioxide, either in gas or in liquid form, is contacted with tobacco to impregnate tobacco and thereafter the carbon dioxide-impregnated tobacco is subjected to rapid heating conditions to volatilize the carbon dioxide and thereby expand the tobacco. Carbon dioxide is a substantial component of the atmosphere and is readily available. Nevertheless, in the carbon dioxide tobacco expansion processes, it is typically necessary to heat the tobacco excessively in order to achieve substantial stable expansion which can result in harm to the tobacco flavor and the generation of excessive amounts of tobacco fines. In addition, those commercially available processes which use liquid carbon dioxide to impregnate tobacco result in impregnated tobacco in the form of solid blocks of tobacco containing dry ice which must be broken up prior to heat treatment, thereby harming the tobacco and increasing the complexity of the process.

U.S. Pat. No. 4,461,310 to Zeihn and U.S. Pat. No. 4,289,148 to Zeihn describe the expansion of tobacco employing supercritical nitrogen or argon impregnation of tobacco. These gases are removed from the tobacco during a rapid pressure reduction and the tobacco is expanded by exposure to heated gas or microwave. These processes require treatment of tobacco at pressures in excess of 2,000 or 4,000 psi up to above 10,000 psi in order to achieve substantial tobacco expansion.

U.S. Pat. No. 4,531,529 to White et al. describes a process for increasing the filling capacity of tobacco wherein the tobacco is impregnated with a low-boiling and highly volatile expansion agent such as a normally gaseous halocarbon or hydrocarbon at process conditions above or near the critical pressure and temperature of the expansion agent. The pressure is quickly released to atmospheric so that the tobacco expands without the necessity of a heating step to either expand the tobacco or to fix the tobacco in the expanded condition.

Various processes have been disclosed for the microwave treatment of tobacco to provide tobacco expansion in U.S. Pat. No. 3,765,425 to Stungis et al., U.S. Pat. No. 3,842,846 to Laszio et al. and U.S. Pat. No. 3,881,498 to Wochnowski, among others. In the Stungis et al. disclosure, tobacco is treated to increase its moisture level or to impregnate the tobacco with an organic expansion agent which absorbs microwaves. Alternatively, the tobacco is treated with an organic expansion agent which does not absorb microwaves, in combination with water and thereafter in any case, the tobacco is exposed to microwave energy to volatilize the moisture and/or organic expansion agent, resulting in tobacco expansion.

Numerous other compounds have been proposed or suggested for expanding tobacco including alkanes, alkenes, alcohols, aldehydes, ketones and ethers. In most instances, various practical problems are encountered however, such as the extraction of desirable flavors from the tobacco during the impregnation step and/or the expansion step; insufficient amount of tobacco expansion; non-uniformity of expansion; reactions between the expansion agent and various components in tobacco; adverse impact on tobacco processing equipment; high levels of retained residual in the final expanded tobacco; and/or hazards such as flammability associated with expansion agents.

There has thus continued to be a search for improvements in known tobacco expansion processes and for new and improved tobacco expansion processes and agents, in general. Yet despite the continuing efforts, commercial success in the field of tobacco expansion has been limited.

SUMMARY OF THE INVENTION

The invention provides a tobacco expansion process which employs sulfur hexafluoride as the expansion agent. It has been found that sulfur hexafluoride can be used to expand tobacco without substantial physical harm to the tobacco and without significant change of tobacco taste and flavors. The process of the invention is conducted by impregnating tobacco with sulfur hexafluoride which is advantageously in liquid form and maintained at a pressure of greater than about 300 psi. Preferably, the impregnation step is conducted at a pressure of between about 350 psi and 2500 psi. The impregnated tobacco is discharged from the impregnation zone at a temperature between about −40° C. and about 35° C., preferably between about −25° C. and about 20° C. At these temperature conditions, the tobacco is in a substantially pliable state and will retain between about 0.50% and about 20%, preferably between about 1.0% and about 10.0% by weight, sulfur hexafluoride. The impregnated tobacco is thereafter heated rapidly in an expansion zone to liberate the retained sulfur hexafluoride and thereby expand the tobacco. Relatively mild heating conditions of between for example, 70° C. and 300° C., advantageously between about 90° C. and 250° C. can be successfully employed to achieve substantial tobacco expansion of greater than 50% increase in filling power.

The expansion agent used in the process of this invention, sulfur hexafluoride, is an odorless, tasteless, colorless and nontoxic gas at room temperature. At atmospheric pressure it sublimes from a solid to gas at −64° C. Despite the low sublimation point of this material, it has been found that sulfur hexafluoride is retained by tobacco at temperatures between −30° C. and 30° C., advantageously between −20° and 20° C., for short periods of time, thus allowing time for transport of impregnated tobacco to a heated expansion zone or for the temporary storage of the impregnated tobacco in an insulated or refrigerated holding zone. Typically, sulfur hexafluoride is retained in the tobacco in amount ranging from about 0.5% by weight to about 20% by weight. Despite the fact that the triple point of sulfur hexafluoride is above atmospheric pressure, (at atmospheric pressure sulfur hexafluoride sublimes from a solid to a gas without passing through a liquid phase) it has been found that tobacco impregnated with sulfur hexafluoride and having a temperature above about −30° C. or preferably above about −20° C., remains substantially pliable, that is, does not contain large blocks of solid tobacco which must later be broken up.

At suitable impregnation temperatures of between about −10° C. and about 45° C., preferably above 10° C., impregnation of sulfur hexafluoride into tobacco has been found to be both rapid and thorough; thus, impregnation times of less than 15 minutes, for example, between 1 and 10 minutes are conveniently employed. Impregnation pressures used in the process of the invention, although superatmospheric, are not excessive. Because relatively mild temperatures can be employed to expand the impregnated tobacco of the invention, tobacco fines generation can be minimized and the impact on tobacco flavor and taste due to heating can be eliminated or minimized. Moreover, there is little if any sulfur hexafluoride retention by the expanded tobacco.

Still another benefit of the expansion process of the invention is that under the impregnation temperatures and pressures employed herein, there is advantageously little if any extraction of valuable flavor components from the tobacco during the impregnation step. Thus, the tobacco removed from the impregnation zone can advantageously be in a substantially unextracted condition. This preserves the taste of the expanded tobacco and also allows for simplification of impregnant recovery steps.

In one advantageous embodiment of the invention, sulfur hexafluoride impregnated tobacco can be expanded employing a microwave treatment. In this embodiment, the tobacco is preferably treated prior to impregnation to provide a moisture content of greater than 15%, preferably between about 25% and about 40%. Following impregnation, the tobacco is rapidly passed through a microwave heating zone. Although sulfur hexafluoride absorbs only minor amounts of microwave energy, the moisture present in the tobacco will absorb microwave energy and generate heat to rapidly volatilize the sulfur hexafluoride expansion agent. Because the volatilization of moisture and sulfur hexafluoride during the microwave heat treatment exerts a cooling effect, the tobacco is maintained at temperatures of about 100° C. or less throughout the heating step. The expanded tobacco can be recovered at a moisture content of, for example, between 7% and 13% by weight, thus eliminating or minimizing the need for a separate, reordering treatment following tobacco expansion.

BRIEF DESCRIPTION OF THE DRAWING

In the drawings which form a portion of the original disclosure of the invention.

DESCRIPTION OF THE PREFERRED EMBODIMENTS

Various preferred embodiments of the invention are described below. It will be understood however that the invention is not limited to the described embodiments; to the contrary, the invention includes various alternatives, modifications and equivalents within its spirit and scope as will be apparent to the skilled artisan.

Tobacco to be treated in the expansion process of the invention can be provided in any of various forms, for example in the form of leaf, strip or cigarette cut filler. Shredded tobacco of 20 to 40 cuts per inch, i.e., cut filler, is preferred because the process is more effective with this smaller particle size and also some of the increase in filling capacity may be lost if expanded tobacco in the form of leaf or strip were subsequently run through a cutter or shredder. If desired, the tobacco may be cased with various flavorants, humectants and the like prior to expansion treatment.

The tobacco to be treated should be in a pliable condition to minimize breakage or shattering during handling and processing. The traditional way of making tobacco pliable is to adjust the water content to within the range of between about 10 and 30%, preferably between about 20 and about 30% moisture. Higher moisture contents also can be, and advantageously are, employed in the process of the invention, particularly when microwave treatment is used to expand the tobacco.

Figure 1:
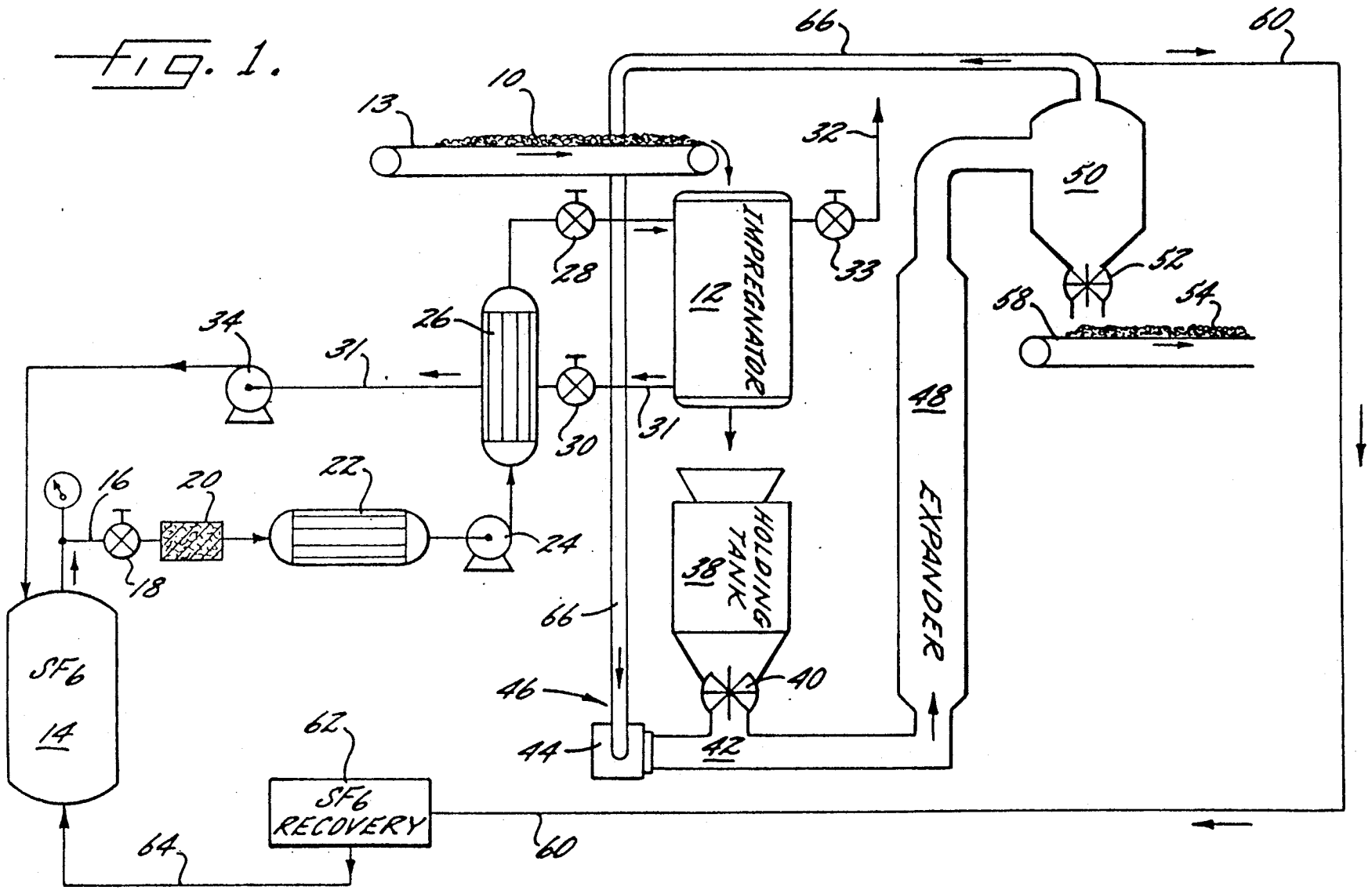
FIG. 1 schematically illustrates one preferred embodiment of the invention wherein tobacco is impregnated with sulfur hexafluoride; discharged from the impregnation zone; and passed to a hot air column for expansion of the tobacco.

With reference to FIG. 1, tobacco, 10 which is preferably in the form of cigarette cut filler is passed to a batch impregnation zone 12 via a conventional loading means such as a conveyor 13. As illustrated in FIG. 1, the impregnator 12 constitutes a batch-type high pressure vessel, such as will be known to the skilled artisan. Any of various and numerous arrangements and accessories can be employed for the pressure vessel. The vessel should advantageously include a valved inlet, near the top or bottom of the vessel for admitting sulfur hexafluoride and a valved outlet at the top or near the bottom of the vessel for removing sulfur hexafluoride. Plural valved outlets at both the top and bottom of the vessel as illustrated in the drawings can also be employed. In addition, a heating or cooling means, such as an external heated jacket, heating coils, or a cooling jacket can be optionally employed in order to maintain the sulfur hexafluoride and tobacco at an impregnating temperature of above about −10° C., preferably between about 0° C. and about 45° C.

Returning to FIG. 1, a supply of sulfur hexafluoride 14, such as a pressurized storage tank containing liquid sulfur hexafluoride, provides sulfur hexafluoride through line 16 via valve 18 to a filter 20 and then to heat exchanger 22. The liquid sulfur hexafluoride is cooled in the heat exchanger by 5° C. to 20° C. to prevent cavitation during pumping. The thus cooled liquid sulfur hexafluoride is pumped by means of high pressure liquid pump 24 through a heat exchanger 26 which heats or cools the sulfur hexafluoride to obtain the desired temperature of between for example about −10° C. and about 90° C., preferably greater than about 10° C. The temperature of the sulfur hexafluoride exiting heat exchanger 26 will likely be different than the desired impregnation temperature since the temperature of the tobacco will affect the temperature of the sulfur hexafluoride upon mixing. Thus the sulfur hexafluoride can advantageously be heated to a temperature of, for example, 10° C.–75° C. Upon addition of the sulfur hexafluoride to the tobacco to via valve 28, the system will reach an equilibrium temperature of between, for example, 10° C. to 45° C.

The sulfur hexafluoride in the impregnator is preferably maintained in liquid form once the vessel has been filled and equilibrium reached and is advantageously supplied in sufficient amount to fully immerse the tobacco in the sulfur hexafluoride. Pressure within the impregnator is at a level sufficient to maintain the sulfur hexafluoride as a liquid and can range from about 220 psi to about 3000 psi or greater with pressures of between 350 psi and 2500 psi being preferred. Advantageously, the temperature during impregnation is maintained at greater than about 10° C., preferably greater than about 20° C., under which conditions a short impregnation time ranging from about 1 to about 30 minutes, preferably between about 2 and about 15 minutes is employed.

Following impregnation for a suitable amount of time, valve 30 is opened allowing sulphur hexafluoride liquid to exit impregnator 10 via line 31. As the liquid exits via line 31, evaporation within the impregnation zone causes the temperature within the impregnator 12 to decrease. If heating has been employed during the impregnation step, it is advantageously discontinued to allow the impregnated tobacco to cool as the liquid sulfur hexafluoride is removed from the impregnator. An outlet line 32 is also provided at the top of the impregnator vessel. Sulfur hexafluoride can be removed in gaseous form via line 32 by opening valve 33 to provide the desired amount of cooling of the impregnated tobacco. Depending on impregnation temperatures and pressures, both upper and lower gas and liquid removal lines 32 and 31, respectively, can be employed for removal of sulfur hexafluoride, or only a single line can be used. Sulfur hexafluoride gas exiting through upper line 32 is passed to a conventional recovery zone (not shown) for recovery and liquification of the sulfur hexafluoride which is then returned to supply tank 14.

Excessive cooling is to be avoided during removal of the sulfur hexafluoride in order to prevent the formation of large, solid blocks of tobacco. Thus, the temperature of the tobacco following discharge of the impregnant is best kept between about −30° C. and 30° C., preferably between about −25° C. and about 20° C., most preferably between −20° C. and 0° C. at which temperatures the impregnated tobacco will be in a substantially pliable form. By "substantially pliable", it is meant that no large frozen solid blocks of tobacco will be formed which need to be broken up prior to heat treatment. Small solid clumps of tobacco may be found and a conventional detangling treatment may be desirable.

The liquid sulfur hexafluoride removed from the impregnator is passed via line 31 through a pump 34 and following any necessary treatment for removal of solids, moisture, or other contaminants, is returned to supply vessel 14.

Tobacco is thereafter removed from the impregnator and advantageously the entire batch of impregnated tobacco is passed to an insulated or refrigerated holding tank 38 although if desired, the tobacco can be passed directly to a heating zone. Upon removal from the impregnator, the tobacco will typically contain from about 1% to about 20% by weight, preferably less than 15% by weight, sulfur hexafluoride. At temperatures of between about −40° C. and about 30° C., preferably less than 20° C., sulfur hexafluoride will be retained in the tobacco in a sufficient amount for subsequent expansion of the tobacco for a time period of up to several minutes e.g. 2 to 10 minutes or longer, without the necessity of cooling or insulating the tobacco. While not wishing to be bound by theory, it is believed that the sulfur hexafluoride is retained by the tobacco because the molecular size of sulfur hexafluoride is relatively large and diffusion of sulfur hexafluoride out of the impregnated tobacco is relatively slow. It is not known whether the sulfur hexafluoride exists within the cellular structure of tobacco primarily as a solid, gas or as a solute. At atmospheric pressure, it is known that sulfur hexafluoride sublimes directly from the solid phase to the gas phase without passing through a liquid phase. Thus, sulfur hexafluoride may exist within the tobacco cellular structure as small solid particles. Nevertheless, it has been found that the process of this invention can be conducted without generation of large solid blocks of tobacco which require a special breaking prior to heat treatment.

Returning to FIG. 1, the entire batch of impregnated tobacco is advantageously passed to holding tank 38 which is preferably insulated and/or refrigerated. Holding tank 38 is preferably sealed during storage of tobacco. Various recovery means (not shown) can be provided in combination with holding tank 38 for recovery of sulfur hexafluoride gas which escapes the impregnated tobacco during the holding period. Such recovery means can take the form of gas lines provided at the top or the bottom of the holding tank for continuously removing sulfur hexafluoride gas during the holding period.

Impregnated tobacco is passed directly from the holding tank via a rotary star valve 40 into the lower portion 42 of an expansion zone. In the lower portion 42 of the expansion zone, the impregnated tobacco is mixed with a rapidly moving stream of hot gases which is provided via a heater (not shown) and fan 44. A source of steam 46 can be provided at a location upstream for mixing with gases which are being recirculated within the expander.

The tobacco is carried by the force of the hot gas stream upwardly through expansion zone 48 and into separator 50 During movement of the tobacco through expansion zones 42 and 48, the sulfur hexafluoride rapidly volatilizes from the tobacco resulting in the stable expansion of the tobacco.

The degree of heating of the tobacco within expansion zone 48 is advantageously kept to a minimum to avoid harming the tobacco flavor and/or to avoid excessive fines generation. Temperatures above 300° C. are preferably avoided in the expansion zone in order to prevent evaporation of excessive moisture from the tobacco and to prevent overheating of the tobacco, although the skilled artisan will recognize that such temperatures can be used, if desired. Advantageously, the expansion zone will contain heated gases at a temperature of between about 90° C. and about 250° C., preferably between about 100° C. and 225° C., most preferably between about 100° C. and 200° C.

Expanded tobacco within cyclone-type separator 50 falls to the bottom portion thereof and is continuously removed by rotary star valve 52. The expanded tobacco 54 is collected on any of various conventional tobacco recovery apparatus such as conveyor 58.

If desired, the expanded tobacco can be passed to a reordering zone and/or a sulfur hexafluoride recovery zone. The reordering process, as is well known to the skilled artisan, comprises a moisture treatment in which expanded tobacco is treated with steam, water vapor or the like in order to increase the moisture content of the tobacco to the desired range of 10%–13%. Typically, the expanded tobacco exiting separator 50 will contain only a minute amount of residual sulfur hexafluoride, for example, 0.15% by weight or less. Due to the high volatility of the sulfur hexafluoride under expansion conditions, the expanded tobacco will, in many cases, depending upon the expansion temperature and composition of the expansion gas, exit the expansion zone with a sulfur hexafluoride content of less than 0.10% by weight.

A portion of the hot gases in the expansion zone are removed via line 60 and are passed to a sulfur hexafluoride stripping zone 62. Sulfur hexafluoride recovered in the stripping zone is passed via line 64 to the sulfur hexafluoride supply tank 14. A portion of the expansion gases, which may include sulfur hexafluoride volatilized from the tobacco, are recirculated via pipe 66 for use in expanding freshly impregnated tobacco.

Figure 2:
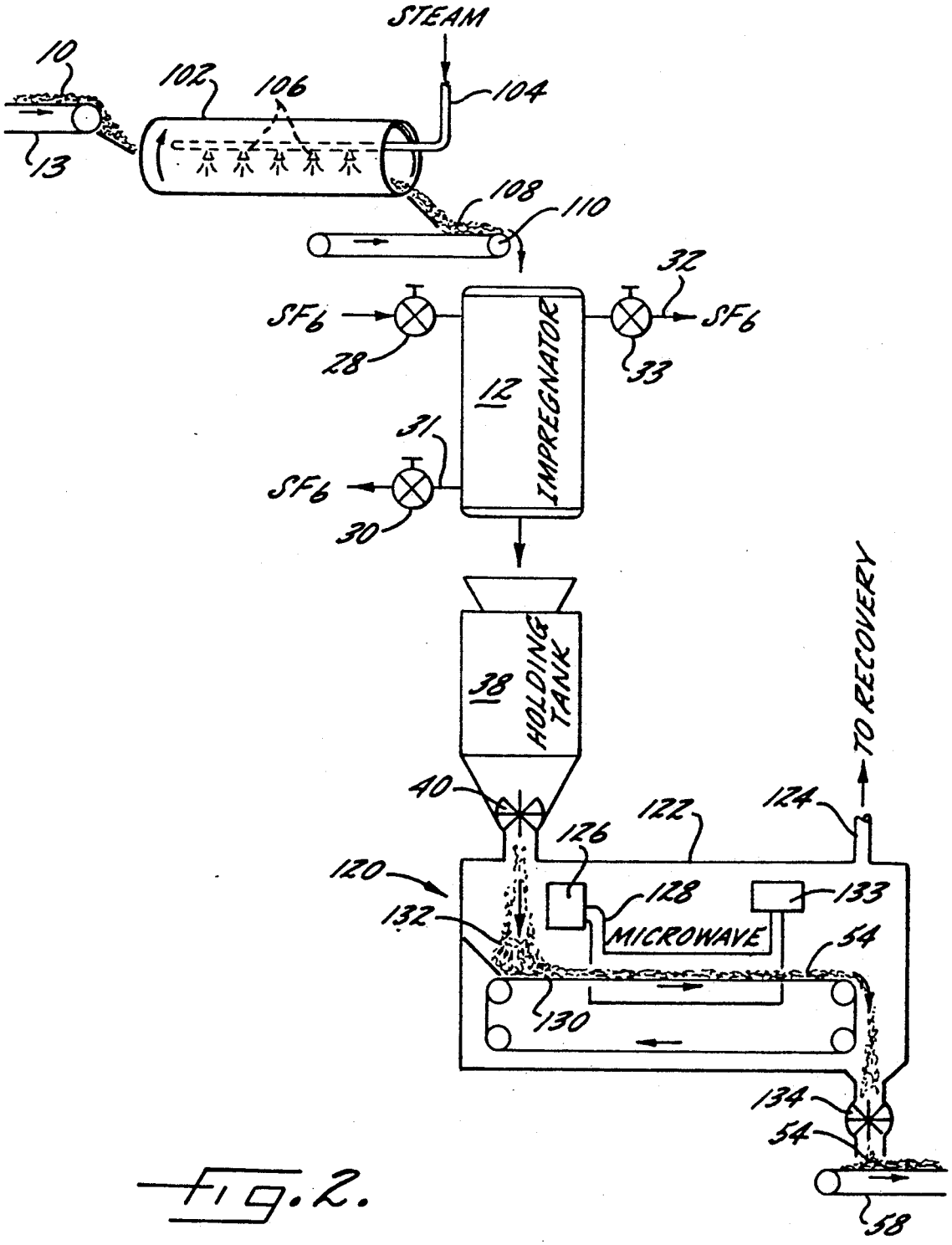
FIG. 2 schematically illustrates another preferred embodiment of the invention in which sulfur hexafluoride impregnated tobacco is expanded in a microwave heating zone.

FIG. 2 illustrates another preferred embodiment of the invention. Tobacco 10 is carried by conveyor 13, for admission into a conditioning drum 102. The tobacco 10 will typically have a moisture content of 12%–15% by weight, and as previously indicated, can have been previously treated by the application of casing or the like. Conditioning drum 102 includes a pipe 104 which admits steam or moisture into the interior thereof. A plurality of nozzles 106, shown in phantom, treat the tobacco inside the conditioning drum with steam or finely divided water. The drum rotates so that all of the tobacco particles are uniformly exposed to the steam or moisture. A plurality of interior flights or vanes (not shown) are preferably provided on the inside of rotating drum 102 so that tobacco is gently agitated while being treated in the conditioning drum. The tobacco is maintained within the conditioning drum for a period of time and under conditions sufficient to raise the equilibrium moisture of the tobacco to greater than 20% by weight, preferably greater than 25% by weight, most advantageously to between about 30% and about 40% by weight.

The treatment to increase moisture content provided in conditioning drum 102, is conducted in order to provide sufficient moisture in the tobacco for later absorption of microwave energy. It has been found that a moisture content in excess of 15% and up to 50% by weight, increases tobacco expansion in the process of the invention when microwave energy is employed for heating the tobacco. Particularly when the moisture content of the tobacco is to be increased to greater than about 25% by weight, the moisturizing conditioning process is conducted at a time close to the impregnation step, for example, from several minutes to several days prior to the impregnation step, preferably less than 24 hours prior to the impregnation step. This can prevent molding of the moist tobacco during storage.

The moistened tobacco 108 is removed from the conditioning drum and carried via a second conveyor 110 to impregnator 12 for the impregnation step in the manner described previously. Tobacco removed from impregnator 12 is then passed to holding tank 38 as previously described.

Tobacco is admitted via star valve 40 into a microwave treatment zone 120 for heating and expansion of the tobacco. The microwave treatment zone is preferably provided within a sealed chamber 122 so that sulfur hexafluoride volatized during the heat treatment can be recovered via line 124.

The microwave treatment zone includes a magnetron 126 which generates microwaves which are transported through waveguide 128. A conveyor belt 130 carries impregnated tobacco 132 through the waveguide 128 wherein the tobacco is exposed to microwaves for a period ranging from several seconds up to about a minute, for example, 5–20 seconds, to thereby heat the moisture in the tobacco which, in turn, volatizes the sulfur hexafluoride in the impregnated tobacco, causing the tobacco to expand. Any microwave energy which passes through the waveguide 128 and is not absorbed by the tobacco is received and absorbed by a conventional water load 133.

Expanded tobacco 54 is removed from the microwave treatment zone by conveyor 130 and passed via rotary star valve 134, to a conventional conveying means such as a conveyor belt 58. The expanded tobacco exiting the microwave treatment zone 120 advantageously has a moisture content in the range of between about 7% and about 13% by weight. The expanded tobacco can be passed to a conventional reordering treatment (not shown) and/or to a sulfur hexafluoride stripping zone; however, typically the tobacco will have a sulfur hexafluoride content of less than about 0.15% by weight so that recovery of the residual sulfur hexafluoride may be unnecessary.

Any of various commercially available microwave heating units may be employed for the microwave treatment of sulfur hexafluoride impregnated tobacco. An exposure time of 9–12 seconds has been employed in a 4.5–5.5 kilowatt treatment zone having a frequency of 2375 MHz and an efficiency of about 50% to treat ¼ to ½ pound per minute. When the bed depth of the impregnated tobacco is expected to exceed several inches, the microwave treatment zone can advantageously include an agitating means for agitating the tobacco during the microwave treatment to ensure that all of the tobacco is uniformly exposed to microwave energy and also to ensure that the impregnated tobacco is not excessively compressed during heating which could interfere with expansion of the tobacco. Such agitation means can include, for example, the use of a microwave-transparent rotary drum within the waveguide; gas lines for fluidizing the tobacco within the waveguide or the like. As will be apparent, the power of the microwave unit will be selected depending upon the amount of tobacco being treated. Exposure times can be increased or decreased also depending upon the amount of tobacco being treated. However, a short, relatively high energy treatment is preferred to ensure maximum tobacco expansion.

In the process of the invention wherein tobacco moisture is adjusted to above about 20% prior to the impregnation step, and particularly when microwave heating is employed, it is preferred that the moisture be fully equilibrated within the tobacco. For example, if the moisture content is increased simply by spraying ambient temperature moisture onto ambient temperature tobacco, the moisture will not rapidly penetrate into the cells of the tobacco. If subsequent microwave heating of the tobacco is conducted within only a few hours, the surface moisture can simply evaporate off of the tobacco without supplying sufficient heat to the sulfur hexafluoride within the interior of the tobacco to promote maximum expansion which would be achievable if the moisture were fully equilibrated into the tobacco. On the other hand, if the tobacco is treated by spraying with water and the moistened tobacco stored for a period of for example, 24 hours, the moisture will fully equilibrate through the cellular structure of the tobacco. Alternatively, treating the tobacco with moisture in the form of steam, as illustrated in FIG. 2, enhances the rate of moisture penetration into the tobacco.

As discussed previously, the impregnation step of the invention can be conducted over a wide range of temperatures and pressures. The time period for complete impregnation will depend, at least in part, upon the temperature and pressure employed during the impregnation step. Thus, higher temperatures and pressures tend to promote more rapid impregnation whereas lower temperatures and pressures can increase the amount of time required for impregnation. Generally, at temperatures above about 20° C. and impregnation pressures of between 750 psi and 2,500 psi, an impregnation time of less than about 15 minutes will be sufficient. Preferred impregnation temperatures range from about 20° C. up to as high as 44° C.–45° C. At these preferred temperatures, impregnation is rapid. Preferred impregnation pressures range from about 1,000 to about 2,500 psi, preferably between about 1,200 psi and about 2,000 psi.

Advantageously, temperature and pressure conditions within the impregnation zone are maintained so that substantially all of the sulfur hexafluoride will be in the liquid phase. Operation within the liquid phase provides substantial contact between the sulfur hexafluoride and the tobacco thereby enhancing rapid and full impregnation. In addition, operation within the liquid phase is believed to increase the amount of sulfur hexafluoride absorbed by the tobacco. However, tobacco can also be impregnated with sulfur hexafluoride in accordance with this invention by operating at temperatures and pressures wherein a portion or all of the sulfur hexafluoride is maintained in the gas phase. In such instances, impregnation times may need be increased and/or the amount of cooling following impregnation may need to be increased in order to provide sufficient impregnation of sulfur hexafluoride into the tobacco and/or sufficient retention of sulfur hexafluoride by the tobacco.

Heating of the impregnated tobacco in order to effect expansion can be accomplished by means other than those discussed previously. Thus the impregnated tobacco can also be heated by radiant means to effect expansion. In another preferred embodiment, the tobacco can be heated in a fluidized bed at a temperature of from 90° C. up to 300° C. Fluidized beds are known in the art and described for example in U.S. Pat. No. 4,270,553 to Conrad et al. which is hereby incorporated herein by reference. The fluidized bed can be used with or without the added hot particles described in this patent If desired, various additives may be employed in the process of the invention. Thus, for example, the tobacco may be pretreated with various alcohols such as ethanol, or with other additives, for example hydrocarbons such as pentane or hexane, in order to promote better expansion.

The invention has been described in connection with various batch embodiments. However, a continual flow process may be used when employing an apparatus having slidably engaged ceramic seals at the entrance and exit ends thereof as described in U.S. patent application Ser. No. 07/367,589 filed June 19, 1989 by Anatoly I. Kramer entitled "Process and Apparatus for the Expansion of Tobacco" and assigned to the assignee of the present invention which is hereby incorporated herein by reference.

The following examples are provided for a more complete understanding of the invention and not by way of limitation. Tobacco moisture content as reported in the examples is expressed as the percent reduction in the tobacco weight upon heating in a convection oven for five minutes at 92° C. Filling capacity measurements of expanded and untreated tobacco samples were performed using a specially designed and electronically automated filling capacity meter in which a solid piston of 3.625 inches in diameter is slidably positioned in a cylinder and exerts a pressure of 26 psi on a tobacco sample located in the cylinder. These parameters are believed to simulate the packing conditions to which tobacco is subjected in cigarette making apparatus during the formation of a cigarette rod. The moisture content of tobacco affects the filling values determined by this method. Therefore, all expanded and unexpanded tobacco samples were submitted for moisture determination. These results were taken into account for calculating corrected filling capacities of tobacco samples through previously obtained correlation tables. Measured tobacco samples were as follows: 100 g. for unexpanded tobacco and 50 g. for expanded tobacco.

The percent increase in filling capacity or percent expansion as reported in the following examples was computed by subtracting the corrected filling capacity of the unexpanded control sample from the corrected filling capacity of the expanded sample, dividing this difference by the corrected filling capacity of the unexpanded control sample and multiplying this quotient times 100.

EXAMPLE 1

Samples of tobacco cut filler were impregnated in a pressure vessel having a volume of 2 liters. The pressure vessel included a thermocouple installed inside the vessel, close to the top thereof, to measure the temperature of the vessel contents and a pressure gauge for indicating the pressure in the vessel. Sulfur hexafluoride was introduced into the vessel through a valve at the bottom of the vessel and removed from the vessel by two valves at the top of the vessel, by opening the valves and allowing the gas contents to escape. A thermostatically controlled heating jacket was provided around the vessel for heating during the impregnation.

A number of samples of tobacco, each weighing 130–170 grams were prepared. The tobacco samples consisted of a blend of cased flue cured and burley tobacco lamina in the form of cut filler. Moisture of the samples was recorded and measured as set forth below. The samples were then impregnated with sulfur hexafluoride for the times set forth below and at the temperature and pressures set forth below. Following impregnation, the tobacco was removed from the treating vessel and heated with a hot air gun. The percent expansion achieved is as set forth below.

TABLE I

| Run # | Impreg. Pressure (psi) | Impreg. Temp. (°C.) | Impreg. Time (min.) | % Moisture Initial | Percent Expansion |
|---|---|---|---|---|---|
| 1 | 480 | 44 | 60 | 17 | 32 |
| 2 | 2030 | 27 | 60 | 19 | 65 |
| 3 | 3000 | 25 | 60 | 18 | 60 |
| 4 | 3000 | 45 | 45 | 21.5 | 57 |
| 5 | 3000 | 45 | 45 | 21.5 | 72 |

Heating with a hot air gun involves various difficulties including non-uniform heating of the tobacco due to the fact that hot air can be directed only upon a limited tobacco area and the temperature of the air reaching the tobacco is only 50° C.–75° C. Nevertheless, as seen above, substantial tobacco expansion was achieved.

EXAMPLE 2

Tobacco samples having a weight of about 150 grams were impregnated using the apparatus of Example 1. The tobacco consisted of the same cased blend of flue cured and burley tobaccos as used in Example 1. The impregnated samples were removed from the impregnating vessel and hand carried, without refrigeration or insulation, to a microwave heating apparatus substantially as illustrated in FIG. 2 except that no gas recovery system was used. The average transport time to microwave processing was about 1.5 to about 2.5 minutes. The waveguide or microwave treating zone had a length of about four feet. The tobacco was carried on a moving belt through the waveguide to provide an exposure time of 9–12 seconds. The power of the microwave was variable up to 6.0 kW maximum. The power setting for the microwave apparatus was as set forth below. In addition to the parameters reported in Example 1, the temperature in the vessel following removal of the sulfur hexafluoride impregnant by venting the sulfur hexafluoride through the top valves was recorded. These temperatures are reported below as "Discharge Temperature"

TABLE II

| Run # | Impreg. Pressure (psig) | Impreg. Temp. (°C.) | Impreg. Time (Minutes) | Discharge Temp. (°C.) | % Moisture Initial | Micro. Power kW | Percent Expansion |
|---|---|---|---|---|---|---|---|
| 1 | 300 | 21 | 15 | −15 | 20 | 4.5 | 30 |
| 2 | 360 | 23 | 15 | −26 | 27 | 4.5 | 49 |
| 3 | 360 | 24 | 15 | −19 | 21 | 4.5 | 47 |

EXAMPLE 3

The procedures of Example 2 were repeated using the same types of tobacco samples, treating vessel, and microwave heating zone, but with different impregnation temperatures and pressures.

TABLE III

| Run # | Impreg. Pressure (psig) | Impreg. Temp. (°C.) | Impreg. Time (Minutes) | Discharge Temp. (°C.) | % Moisture Initial | Micro. Power kW | Percent Expansion |
|---|---|---|---|---|---|---|---|
| 1 | 400 | 16 | 15 | −30 | 25 | 5 | 42 |
| 2 | 400 | 24 | 15 | −23 | 27 | 5 | 58 |
| 3 | 400 | 20 | 15 | −27 | 35 | 5.5 | 62 |

In Run #1 above, some small frozen tobacco lumps were observed. It is believed that the amount of microwave energy used was insufficient to heat the tobacco fully in view of this icing.

EXAMPLE 4

The procedures of Example 2 were repeated using the same types of tobacco samples, treating vessel, and microwave heating zone, but with different impregnation temperatures and pressures.

TABLE IV

| Run # | Impreg. Pressure (psig) | Impreg. Temp. (°C.) | Impreg. Time (Minutes) | Discharge Temp. (°C.) | % Moisture Initial | Micro. Power kW | Percent Expansion |
|---|---|---|---|---|---|---|---|
| 1 | 500 | 24 | 15 | −23 | 19 | 4.5 | 39 |
| 2 | 500 | 27 | 15 | −10 | 19 | 4.5 | 50 |
| 3 | 500 | 31 | 15 | +3 | 25 | 5.0 | 71 |

In Run #1 some small frozen tobacco lumps were observed and it is believed that the microwave power was insufficient to fully heat the tobacco. Additionally, it is believed that the increased moisture content of RUN #3 was at least partially responsible for the increased amount of tobacco expansion observed.

EXAMPLE 5

The procedures of Example 2 were repeated using the same types of tobacco samples, treating vessel, and microwave heating zone, but with different impregnation temperatures and pressures.

TABLE V

| Run # | Impreg. Pressure (psig) | Impreg. Temp. (°C.) | Impreg. Time (Minutes) | Discharge Temp. (°C.) | % Moisture Initial | Micro. Power kW | Percent Expansion |
|---|---|---|---|---|---|---|---|
| 1 | 600 | 25 | 15 | −10 | 19 | 4.5 | 38 |
| 2 | 600 | 31 | 15 | +6 | 25 | 4.5 | 47 |

It can be seen that the increased moisture content of the tobacco and increased impregnation temperature provided for improved expansion.

EXAMPLE 6

The procedures of Example 2 were repeated using the same types of tobacco samples, treating vessel, and microwave heating zone but with different impregnation temperatures and pressures.

TABLE VI

| Run # | Impreg. Pressure (psig) | Impreg. Temp. (°C.) | Impreg. Time (Minutes) | Discharge Temp. (°C.) | % Moisture Initial | Micro. Power kW | Percent Expansion |
|---|---|---|---|---|---|---|---|
| 1 | 700 | 33 | 15 | +3 | 19 | 5.5 | 46 |
| 2 | 700 | 25 | 15 | −22 | 23.5 | 5.5 | 46 |
| 3 | 700 | 28 | 15 | −13 | 36 | 5.5 | 67 |

As with the previous examples, increasing the moisture content and impregnation temperature increased the percent tobacco expansion.

EXAMPLE 7

The procedures of Example 2 were repeated using the same types of tobacco samples, treating vessel, and microwave heating zone, but with different impregnation temperatures and pressures.

TABLE VII

| Run # | Impreg. Pressure (psig) | Impreg. Temp. (°C.) | Impreg. Time (Minutes) | Discharge Temp. (°C.) | % Moisture Initial | Micro. Power kW | Percent Expansion |
|---|---|---|---|---|---|---|---|
| 1 | 900 | 28 | 15 | −18 | 19 | 5.5 | 53 |
| 2 | 900 | 31 | 15 | −15 | 25 | 4.7 | 61 |
| 3 | 900 | 30 | 15 | −14 | 32 | 5.0 | 65 |

EXAMPLE 8

The procedures of Example 2 were repeated using the same types of tobacco samples, treating vessel, and microwave heating zone, but with different impregnation temperatures and pressures.

TABLE VIII

| Run # | Impreg. Pressure (psig) | Impreg. Temp. (°C.) | Impreg. Time (Minutes) | Discharge Temp. (°C.) | % Moisture Initial | Micro. Power kW | Percent Expansion |
|---|---|---|---|---|---|---|---|
| 1 | 1100 | 38 | 7 | −3 | 25 | 5.0 | 71 |
| 2 | 1100 | 37 | 15 | −5 | 35 | 5.5 | 77 |
| 3 | 1100 | 36 | 15 | −5 | 31 | 5.5 | 83 |

EXAMPLE 9

The procedures of Example 2 were repeated using the same types of tobacco samples, treating vessel, and microwave heating zone, but with different impregnation temperatures and pressures.

TABLE IX

| Run # | Impreg. Pressure (psig) | Impreg. Temp. (°C.) | Impreg. Time (Minutes) | Discharge Temp. (°C.) | % Moisture Initial | Micro. Power kW | Percent Expansion |
|---|---|---|---|---|---|---|---|
| 1 | 1500 | 39 | 7 | −6 | 19 | 5.0 | 58 |
| 2 | 1500 | 36 | 7 | −10 | 25 | 5.0 | 74 |
| 3 | 1500 | 39 | 7 | −7 | 35 | 5.5 | 80 |
| 4 | 1500 | 35 | 7 | −5 | 39 | 5.5 | 89 |

EXAMPLE 10

The procedures of Example 2 were repeated using the same types of tobacco samples, treating vessel, and microwave heating zone, but with different impregnation temperatures and pressures.

TABLE X

| Run # | Impreg. Pressure (psig) | Impreg. Temp. (°C.) | Impreg. Time (Minutes) | Discharge Temp. (°C.) | % Moisture Initial | Micro. Power kW | Percent Expansion |
|---|---|---|---|---|---|---|---|
| 1 | 1700 | 43 | 15 | −1 | 19 | 4.5 | 57 |
| 2 | 1700 | 44 | 7 | −2 | 19 | 4.5 | 51 |
| 3 | 1700 | 38 | 7 | −10 | 23 | 5.0 | 76 |

TABLE X-continued

| Run # | Impreg. Pressure (psig) | Impreg. Temp. (°C.) | Impreg. Time (Minutes) | Discharge Temp. (°C.) | % Moisture Initial | Micro. Power kW | Percent Expansion |
|---|---|---|---|---|---|---|---|
| 4 | 1700 | 41 | 7 | −5 | 35 | 5.0 | 84 |

As is apparent, substantially less tobacco expansion was obtained when the moisture content of the tobacco was lower.

EXAMPLE 11

The procedures of Example 2 were repeated using the same types of tobacco samples, treating vessel, and microwave heating zone, but with different impregnation temperatures and pressures. In this example, moisture contents were kept low to observe the moisture content effect in microwave expansion.

TABLE XI

| Run # | Impreg. Pressure (psig) | Impreg. Temp. (°C.) | Impreg. Time (Minutes) | Discharge Temp. (°C.) | % Moisture Initial | Micro. Power kW | Percent Expansion |
|---|---|---|---|---|---|---|---|
| 1 | 1700 | 44 | 7 | −1 | 12.5 | 4.0 | 36 |
| 2 | 1700 | 41 | 15 | −6 | 16 | 5.0 | 39 |

It can be seen that moisture content can have a significant impact on tobacco expansion.

EXAMPLE 12

The procedures of Example 2 were repeated using the same types of tobacco samples, treating vessel, and microwave zone, but with different impregnation temperatures and pressures.

TABLE XII

| Run # | Impreg. Pressure (psig) | Impreg. Temp. (°C.) | Impreg. Time (Minutes) | Discharge Temp. (°C.) | % Moisture Initial | Micro. Power kW | Percent Expansion |
|---|---|---|---|---|---|---|---|
| 1 | 2000 | 44 | 7 | 0 | 25 | 5.0 | 79 |
| 2 | 2000 | 36 | 7 | −4 | 35 | 5.0 | 82 |
| 3 | 2000 | 41 | 7 | −4 | 21.5 | 5.0 | 60 |

EXAMPLE 13

The procedures of Example 2 were repeated using the same types of tobacco samples, treating vessel, and microwave heating zone, but with different impregnation temperatures and pressures.

TABLE XIII

| Run # | Impreg. Pressure (psig) | Impreg. Temp. (°C.) | Impreg. Time (Minutes) | Discharge Temp. (°C.) | % Moisture Initial | Micro. Power kW | Percent Expansion |
|---|---|---|---|---|---|---|---|
| 1 | 2500 | 43 | 7 | −6 | 21 | 5.0 | 68 |
| 2 | 2500 | 41 | 7 | +3 | 30 | 5.0 | 79 |
| 3 | 2500 | 43 | 15 | −2 | 35 | 5.0 | 89 |
| 4 | 2500 | 44 | 7 | +2 | 35 | 5.0 | 84 |
| 5 | 2500 | 45 | 7 | −1 | 35 | 5.5 | 94 |

The procedures of Example 2 were repeated except that following impregnation, the sulfur hexafluoride was removed from the bottom of the vessel as a liquid and thus the temperature of the impregnated tobacco was substantially higher due to less cooling from evaporation of sulfur hexafluoride during the decomposition step. The following results were obtained.

TABLE XIV

| Run # | Impreg. Pressure (psig) | Impreg. Temp. (°C.) | Impreg. Time (Minutes) | Discharge Temp. (°C.) | % Moisture Initial | Micro. Power kW | Percent Expansion |
|---|---|---|---|---|---|---|---|
| 1 | 1700 | 43 | 7 | 23 | 35 | 5.5 | 60 |
| 2 | 1700 | 43 | 7 | 21 | 35 | 5.5 | 62 |

It can be seen that even when the tobacco was removed from the impregnation zone at a high temperature, sufficient sulfur hexafluoride was retained by the tobacco during the approximate one minute transport time between the impregnation zone and the microwave heating zone, so that substantial tobacco expansion was achieved.

EXAMPLE 15

Tobacco samples were impregnated as in Example 2. The tobacco samples were weighed immediately before and immediately after impregnation. The difference in weight was assumed to be due to absorbed sulfur hexafluoride. Impregnation pressures were generally about 1700 psi. Impregnation temperatures and time were generally about 40° C. and 7 minutes, respectively. The discharge temperature upon decompression of the impregnation vessel was generally between −5° C. and 0° C. It was found that immediately after impregnation, the samples contained between 1.2% and 2.8% by weight, sulfur hexafluoride. The samples were allowed to stand, open to the atmosphere at 25° C. for a period of 1 minute, and were then weighed again. It was found that approximately 35%–40% of the retained sulfur hexafluoride had been lost to the atmosphere by evaporation. Nevertheless, substantial expansion could be obtained by heating the impregnated samples of tobacco.

EXAMPLE 16

The impregnation procedures of Example 2 were repeated and the entire batch of impregnated tobacco was heated in a fluidized bed. The impregnation pressure was 1,700 psi. The impregnation temperature and time were 39° C. and 9 minutes, respectively. The initial moisture of the sample was 35% by weight. Hot air having a temperature of 90° C. was employed as the fluidizing medium and the tobacco was heated for about 50 seconds. Following heat treatment, the tobacco had obtained a 52% increase in filling capacity. The expanded tobacco was recovered with a moisture content of about 12% by weight.

The invention has been described in considerable detail with specific reference to preferred embodiments. However, it will be apparent that variations and modifications can be made within the spirit and scope of the invention as described in the foregoing detailed specification and defined in the appended claims.

What is claimed is:

1. A process for expanding tobacco comprising the steps:

(a) impregnating tobacco in an impregnation zone with an expansion agent comprising sulfur hexafluoride at a pressure of at least 300 psi;

(b) discharging impregnated tobacco from the impregnation zone the impregnated tobacco comprising at least about 0.5% by weight sulfur hexafluoride; and (c) heating the impregnated tobacco in an expansion zone under conditions effective to liberate the sulfur hexafluoride therein and cause expansion of the tobacco.

2. The process of claim 1 wherein the pressure in the impregnation zone is between about 500 and about 3,000 psi.

3. The process of claim 1 wherein the pressure within the impregnation zone is between about 750 and about 2,000 psi.

4. The process of claim 1 wherein the temperature in the impregnation zone is maintained at least about 0° C. during the impregnating step.

5. The process of claim 1 wherein the temperature in the impregnation zone is maintained at least about 10° C. during the impregnating step.

6. The process of claim 1 wherein the impregnated tobacco discharged from the impregnation zone comprises at least about 1% by weight, sulfur hexafluoride.

7. The process of claim 1 wherein the impregnated tobacco discharged from the impregnation zone has a temperature within the range of between about −30° C. and +30° C.

8. The process of claim 1 wherein the impregnated tobacco discharged from the impregnation zone has a temperature in the range of between about −20° C. and about +20° C.

9. The process of claim 1 wherein the tobacco impregnated in the impregnation zone has an initial moisture content of between about 15% and about 50% by weight.

10. The process of claim 1 wherein the tobacco impregnated in the impregnation zone has an initial moisture content of between about 20% and about 35% by weight.

11. The process of claim 1 wherein the impregnated tobacco discharged from the impregnation zone is heated in the expansion zone to a temperature in the range of between about 100° C. and about 250° C.

12. The process of claim 11 wherein the impregnated tobacco is heated in the expansion zone by treating the tobacco with hot gases.

13. The process of claim 11 wherein the impregnated tobacco is heated in the expansion zone by exposing the impregnated tobacco to microwave energy.

14. The process of claim 1 wherein the impregnated tobacco is passed to a holding zone prior to the heating step, and is held in the holding zone for a period of between about 10 seconds and about 30 minutes.

15. A process for expanding tobacco comprising the steps:

(a) impregnating tobacco in an impregnation zone with an expansion agent comprising liquid sulfur hexafluoride;

(b) discharging impregnated tobacco from the impregnation zone, the impregnated tobacco being in a substantially pliable condition at a temperature of between about −30° C. and 35° C. and comprising at least about 0.5% by weight sulfur hexafluoride; and (c) heating the tobacco in an expansion zone under conditions effective to liberate the sulfur hexafluoride therein and cause expansion of the tobacco.

16. The process of claim 15 wherein the pressure in the impregnation zone is maintained at between about 220 psi and about 2,000 psi.

17. The process of claim 16 wherein the temperature in the impregnation zone is maintained at a temperature above about 10° C.

18. The process of claim 15 wherein the impregnated tobacco discharged from the impregnation zone is at a temperature between about −20° C. and 20° C.

19. The process of claim 15 wherein the initial moisture content of the tobacco treated in the impregnation zone is between about 20% and about 35% by weight.

20. The process of claim 15 wherein the impregnated tobacco is heated in the expansion zone at a temperature of between about 100° C. and about 250° C.

21. The process of claim 20 wherein the tobacco is heated by means of a stream of hot gases.

22. The process of claim 20 wherein the impregnated tobacco is heated by treating the tobacco in a microwave heating zone.

23. The process of claim 15 wherein the tobacco is treated in the impregnation zone as a batch.

24. A process for expanding a tobacco comprising the steps:

(a) immersing cut filler tobacco lamina in liquid sulfur hexafluoride in an impregnation zone maintained at a pressure of at least 300 psi and a temperature of between about −10° C. and 45° C.;

(b) recovering impregnated tobacco from the impregnation zone, the impregnated tobacco being in a substantially pliable condition at a temperature between about −30° C. and about 30° C. and comprising at least about 0.5% sulfur hexafluoride absorbed within the cellular structure of the tobacco; and (c) heating the impregnated tobacco in an expansion zone at a temperature between about 100° C. and about 300° C. to thereby liberate the sulfur hexafluoride from the tobacco and cause expansion of the tobacco by at least 50%.

25. The process of claim 24 wherein the cut filler tobacco lamina treated in the impregnation zone has a moisture content of between about 16% and about 50% by weight.

26. The process of claim 25 wherein the moisture content is within the range of from about 20% to about 35% by weight.

27. The process of claim 25 wherein the pressure in the impregnation zone is maintained within the range of between about 750 psi and about 2,000 psi.

28. The process of claim 27 wherein the temperature in the impregnation zone is maintained during the impregnation step at 10° C. or greater.

29. The process of claim 28 wherein the impregnated tobacco discharged from the impregnation zone has a temperature of less than about 20° C.

30. The process of claim 29 wherein the impregnated tobacco discharged from the impregnation zone has a sulfur hexafluoride content of at least 1.0% by weight.

31. A process for expanding tobacco comprising the steps:

(a) treating tobacco in a moisture conditioning zone to increase its moisture content to between about 20% and about 50% by weight;

(b) impregnating the treated tobacco in an impregnation zone with an expansion agent comprising sulfur hexafluoride;

(c) discharging impregnated tobacco from the impregnation zone, the impregnated tobacco being in a substantially pliable condition and comprising at least 0.5% by weight sulfur hexafluoride; and (d) heating the impregnated tobacco in a microwave heating zone under conditions effective to liberate the sulfur hexafluoride contained in the tobacco and thereby cause expansion of the tobacco.

32. A process for expanding tobacco comprising the steps:

(a) impregnating tobacco in an impregnation zone with an expansion agent comprising sulfur hexafluoride for a period of at least about 1 minute under conditions sufficient to cause the sulfur hexafluoride to permeate the tobacco;

(b) discharging impregnated tobacco from the impregnation zone, the impregnated tobacco being in a substantially pliable condition and being at a temperature of less than about 25° C. and comprising at least about 0.5% by weight sulfur hexafluoride; and (c) heating the impregnated tobacco in an expansion zone under conditions effective to liberate the sulfur hexafluoride from the tobacco and cause expansion of the tobacco by at least about 50%.

33. The process of claim 32 wherein the sulfur hexafluoride is maintained substantially in the liquid phase in the impregnation zone throughout the impregnating period of at least about 1 minute.

34. The process of claim 33 wherein the impregnated tobacco discharged from the impregnation zone has a sulfur hexafluoride content of at least about 1.0% by weight.

35. The process of claim 34 wherein the pressure within the impregnation zone is maintained within the range of between about 300 psi and about 2,000 psi throughout the impregnating time period of greater than about 1 minute.

36. The process of claim 35 wherein the tobacco impregnated in the impregnation zone has a moisture content of between about 16% and about 35% by weight.

37. The process of claim 36 wherein the tobacco is heated in the expansion zone to a temperature of less than about 300° C. treated as a batch in the impregnation zone.

38. The process of claim 37 wherein the tobacco is treated as a batch in the impregnation zone.

39. The process of claim 38 wherein the pressure in the impregnation zone is maintained at greater than about 750 psi during the impregnating time period of greater than about 1 minute.

40. The process of claim 39 wherein the tobacco is impregnated in the impregnation zone for an impregnating time period of less than about 15 minutes.

41. An intermediate tobacco product comprising 100 parts by weight tobacco cut filler lamina and greater than about 0.5% by weight sulfur hexafluoride, the tobacco being substantially pliable and in substantially unextracted condition.

* * * * *